US012808222B2

(12) United States Patent
Buldain

(10) Patent No.: US 12,808,222 B2
(45) Date of Patent: Nov. 24, 2026

(54) ANCHORING DEVICE FOR INDUSTRIALIZED MODULAR CONSTRUCTIONS

(71) Applicant: EKONSTEAM, S.L., Loiu (ES)

(72) Inventor: Pedro Rebollar Buldain, Abanto Y Zierbena (ES)

(73) Assignee: EKONSTEAM, S.L., Loiu (ES)

( * ) Notice: Subject to any disclaimer, the term of this patent is extended or adjusted under 35 U.S.C. 154(b) by 142 days.

(21) Appl. No.: 18/747,928

(22) Filed: Jun. 19, 2024

(65) Prior Publication Data

US 2024/0426127 A1 Dec. 26, 2024

(30) Foreign Application Priority Data

Jun. 20, 2023 (ES) ..... ES202331098U

(51) Int. Cl.

| | |
|---|---|
| ***E04H 12/22*** | (2006.01) |
| ***E02D 5/74*** | (2006.01) |
| ***E02D 27/42*** | (2006.01) |
| ***E04B 1/24*** | (2006.01) |
| ***E04B 1/348*** | (2006.01) |

(52) U.S. Cl.

CPC ..... *E04H 12/2261* (2013.01); *E02D 5/74* (2013.01); *E02D 27/42* (2013.01); *E04B 1/2403* (2013.01); *E04B 1/348* (2013.01); *E04H 12/2269* (2013.01); *E04H 12/2284* (2013.01); *E04B 2001/246* (2013.01); *E04B 2001/2463* (2013.01)

(58) Field of Classification Search

CPC ..... E02D 5/74; E02D 27/42; E04B 1/2403; E04B 1/348; E04B 2001/246; E04B 2001/2463; E04H 12/2261; E04H 12/2269; E04H 12/2284

See application file for complete search history.

(56) References Cited

U.S. PATENT DOCUMENTS

| | | | | | |
|---|---|---|---|---|---|
| 2,910,314 | A * | 10/1959 | Klein | F16B 7/04 | 403/174 |
| 4,793,111 | A * | 12/1988 | Shewchuk | F21V 21/10 | 52/298 |
| 5,878,540 | A * | 3/1999 | Morstein | E02D 27/42 | 52/292 |
| 6,438,904 | B1 * | 8/2002 | Anzai | E04H 9/021 | 52/167.1 |
| 7,155,867 | B2 * | 1/2007 | Saldarelli | E04H 12/2261 | 52/301 |
| 11,933,062 | B2 * | 3/2024 | Elpers | E04H 12/2253 | |

(Continued)

FOREIGN PATENT DOCUMENTS

| | | |
|---|---|---|
| ES | 2375562 T3 | 3/2012 |
| ES | 2670471 A1 | 5/2018 |
| ES | 2761652 A1 | 5/2020 |

*Primary Examiner* — Jessie T Fonseca

(57) ABSTRACT

Anchoring device for industrialized modular constructions, comprising a first anchoring system, for joining an industrialized unit to a foundation, and a second anchoring system, for mutual joining of two industrialized units of a dwelling. The first and second sockets comprise troncopiramidal tip for receiving the pillars of the industrialized unit, and the fixation of the joints is performed by adding structural resin from the top face of the pillar through a tube inserted into the pillar.

2 Claims, 5 Drawing Sheets

(56) References Cited

U.S. PATENT DOCUMENTS

| | | | | |
|---|---|---|---|---|
| 2004/0010991 | A1* | 1/2004 | Felser | E04B 1/84 52/272 |
| 2005/0016085 | A1* | 1/2005 | Saldarelli | E04H 12/2261 52/169.9 |
| 2009/0272053 | A1* | 11/2009 | Dent | E04H 12/2261 52/699 |
| 2013/0061453 | A1* | 3/2013 | Rosendahl | E04H 5/04 29/428 |
| 2017/0233996 | A1* | 8/2017 | Abernathy | F16B 7/0433 52/698 |
| 2018/0148919 | A1* | 5/2018 | Rebollar Buldain | E04B 1/2403 |
| 2018/0251996 | A1 | 9/2018 | Roy | |
| 2019/0257076 | A1* | 8/2019 | Abernathy | E04B 1/5831 |
| 2020/0340649 | A1* | 10/2020 | Oliver | E04H 12/2261 |
| 2020/0378106 | A1* | 12/2020 | Post | E04B 1/2403 |
| 2021/0123259 | A1* | 4/2021 | Schneider | E04H 17/009 |
| 2021/0207358 | A1* | 7/2021 | Jin | E04H 9/024 |
| 2021/0262247 | A1* | 8/2021 | Kightlinger | E04H 12/2261 |

* cited by examiner

ANCHORING DEVICE FOR INDUSTRIALIZED MODULAR CONSTRUCTIONS

CROSS-REFERENCE TO RELATED APPLICATIONS AND PRIORITY CLAIM

This application claims priority to Spanish Utility Model No. U202331098 filed on Jun. 20, 2023. The content of the above-identified application is incorporated herein by reference.

DESCRIPTION

Object of the Disclosure

The present disclosure belongs to the field of building technology, and more specifically to the field of industrialized modular building construction.

The subject matter of the disclosure is an improved anchoring device for modular building systems comprising industrialized units, which among other advantages facilitates the joining between said industrialized units. Furthermore, unlike the current state of the art, the device allows access to the connection elements between units from the top of the pillars, thus allowing the finishing of both the interior and the facade of the building to which the industrialized units are linked, without having to act on the nodes for their connection.

Background

Currently, in the anchoring systems to foundations available in the market for industrialized units with more than four pillars, the central anchors lack pillar clearance. Therefore, during the positioning of the unit, misalignment between the facades of adjacent industrialized units can occur.

Connections between pillars are usually made using bolts and dowels as well as through adjusting screws. To access the connections of the first type, two access points per anchor are required to complete the joint. In the case of anchors between interior industrialized units, it is necessary to leave part of the floor slab unfinished to be able to access from both sides of the joint between pillars. In the case of connections using adjusting screws, access is from one side of the joint between the pillars.

The anchoring systems of the first type comprise sockets welded to the anchor plate, which lack means that can facilitate positioning tasks. This makes such tasks complex especially when there are more than four pillars per industrialized unit. It is therefore necessary to use auxiliary means such as levers, nails, etc., for the pillars to enter the sockets of the anchor plates, with the consequent increase in risk for both workers and the industrialized unit itself.

The anchoring systems between conventional units existing in the market, those of the first type, usually involve bolted joints that require access from both sides of the joint. This prevents the facade closures of the industrialized units from being fully installed at the factory, since the area of the joints must be left open. Consequently, it is necessary to subsequently carry out facade closure work on-site, leaving areas open through which rainwater can penetrate, etc.

Additionally, current anchoring systems often lack mechanisms at the joints that allow for adjustment between units for proper alignment. Again, this necessitates subsequent work to correct misalignments between units. Also, lacking means to facilitate positioning complicates this, often requiring the use of levers, nails, etc., to perform the operation.

Regarding current solutions for joining with regulating screws, while they improve the safety of assembly and alignment work, access to these regulating screws must be provided through one of the joined faces. Therefore, these faces must be finished later at the site, resulting in industrialized units leaving the factory with a significantly inferior finish compared to adjustment solutions that do not require access from either face.

Several patent documents related to anchoring systems of this type are known in the current state of the art. For example, document ES2761652A1, by the same inventor, refers to an anchoring system for anchoring an industrialized unit to a building foundation and a system for joining two industrialized units of a building. Document ES2670471A1 discloses an anchoring and joining assembly for modular constructions that allows anchoring factory-built modules to the building foundation, as well as joining the modules forming the same, thus avoiding the clearances present in current systems.

Document US2018251996A1 describes a plate system for the aligned mounting of a structure to a foundation, with a plurality of slots and screws. Lastly, document ES2375562T3 refers to an adjustment device for a base intended to be inserted into the ground, comprising two mounting plates that are positioned basically opposite each other.

For this reason, improved anchoring systems are needed to overcome the aforementioned disadvantages. The present disclosure is focused on solving theose disadvantages.

SUMMARY

An object of the disclosure is an anchoring device for industrialized modular constructions that allows both anchoring a modular unit to a foundation and anchoring for the mutual joining of two modular units in a building. This anchoring is carried out using plates and, welded to them, coupling sockets with truncated pyramid tips to facilitate on-site assembly between the pillar and the socket, using screw systems that provide clearances to enable precise alignment adjustment.

For this purpose, embodiments of the device comprise a first anchor, for joining an industrialized unit to a home foundation, and a second anchor, for joining two industrialized units of a home.

The first anchor, for joining an industrialized unit to a home foundation, comprises a lower plate adjustable in height with respect to the home foundation using a set of threaded rods and nuts. The first anchor also comprises an upper plate with through-holes that allow the passage of the threaded rods, thus connecting both anchor plates.

The diameter of the holes of the upper plate may have an allowance for the displacement of the upper plate with respect to the lower plate.

The upper plate may also include two welded connecting sockets. The adjustment between the connecting sockets and each of the pillars of the industrialized unit occurs thanks to the clearance between the outer faces of the sockets and the inner faces of the pillars. The fixation of the pillars to the sockets of each industrialized unit is achieved by adding structural resin, which is done from the upper end of each pillar of the industrialized unit. Additionally, each socket has a troncopiramidal tip resembling a little roof to facilitate assembly on-site between the pillar of the industrialized unit and the connecting socket.

Thus, the first anchor comprises two plates, with the lower one being larger than the upper one to ensure that if the upper plate has to move relative to the lower one during the positioning of the industrialized unit, the upper plate remains fully in contact with the lower plate.

As already mentioned, the height of the lower plate can be adjusted with respect to the foundation using nuts and grower washers. These components, by exerting extra pressure between contact surfaces, achieve extreme firmness and provide greater security against loosening of the joints due to the spring system they possess. Additionally, there are threaded rods passing through both the lower and upper plates. Once the correct height of the lower plate is achieved, the lower plate is secured to the foundation using a fluid anchoring mortar.

By fixing the joint in the anchor plate sockets through the addition of a structural resin on the upper face of each pillar, it is possible to finish the entirety of each industrialized unit, including the enclosure and facade cladding, improving the fixings compared to bolt-pins and regulating-fixing screws as seen in systems currently commercialized in the market.

A truncated pyramid or four-water roof surface is incorporated into the tip of the union sockets to allow the pillars to easily find these tips of the sockets during the positioning of the industrialized units for on-site pillar assembly.

The second anchorage, for the mutual connection of two industrialized units, comprises a first plate, weldable to each pillar, with a vertical screw in each pillar, allowing the fixation of a second anchoring plate, which in turn carries two upper sockets welded to enable the fixation of the lower pillars. The pair of upper sockets includes a truncated pyramid tip for receiving the pillars of the upper industrialized unit.

Advantageously, in the second anchorage, the joint is first made by screwing the second anchoring plate with the sockets to the first plate, welded to each of the pillars of the lower industrialized units, through the vertical screw of each lower pillar. Once the upper industrialized units are deposited, the final fixation is achieved by adding structural resin.

This second anchorage offers a way to secure industrialized units from within the pillar, without the need to access any of the pillar faces, allowing for the completion of facade cladding and finishing inside the units at the factory. This prevents rainwater from entering the building during the assembly phase on-site and ensures that interior work in the industrialized units is completed without having to access the pillar faces from inside the dwellings.

Furthermore, by incorporating clearances between the outer walls of the sockets and the inner walls of the pillars, precise alignment adjustment between industrialized units is facilitated, thus avoiding the need for additional work to correct misalignments between units. To complete the fixation of the second anchor, structural resin is added through a tube from the top and interior of the pillars.

Additionally, two inclined planes are included on the upper sockets of the joints so that, during the positioning of the industrialized units, the pillars easily find the tips of the sockets for their definitive placement without the need for auxiliary elements. This design also allows access to the nuts to ensure pre-tensioned union using a torque wrench.

The fundamental difference of this device compared to the prior art lies in its ability to adjust the positioning of the modules and their fixation without intervening from outside or inside the module, allowing the modules to be fully finished at the factory. This is achieved because the troncopiramidal tip that enters the pillars has a smaller section than the inside of the pillar, enabling flexibility in positioning. The final key is that structural adhesive can be poured from the top of each module pillar to produce the behavior of embedding the joint.

DESCRIPTION OF THE DRAWINGS

To complement the description being provided and in order to assist in a better understanding of the features of the disclosure, in accordance with a preferred example of practical embodiment thereof, there is attached as an integral part of said description a set of drawings wherein, by way of illustration and not limitation, the following has been depicted.

DETAILED DESCRIPTION

There follows, with the aid of the figures referred to above, a detailed explanation of an example of a preferred embodiment of the subject matter of the present disclosure.

Figure 1:
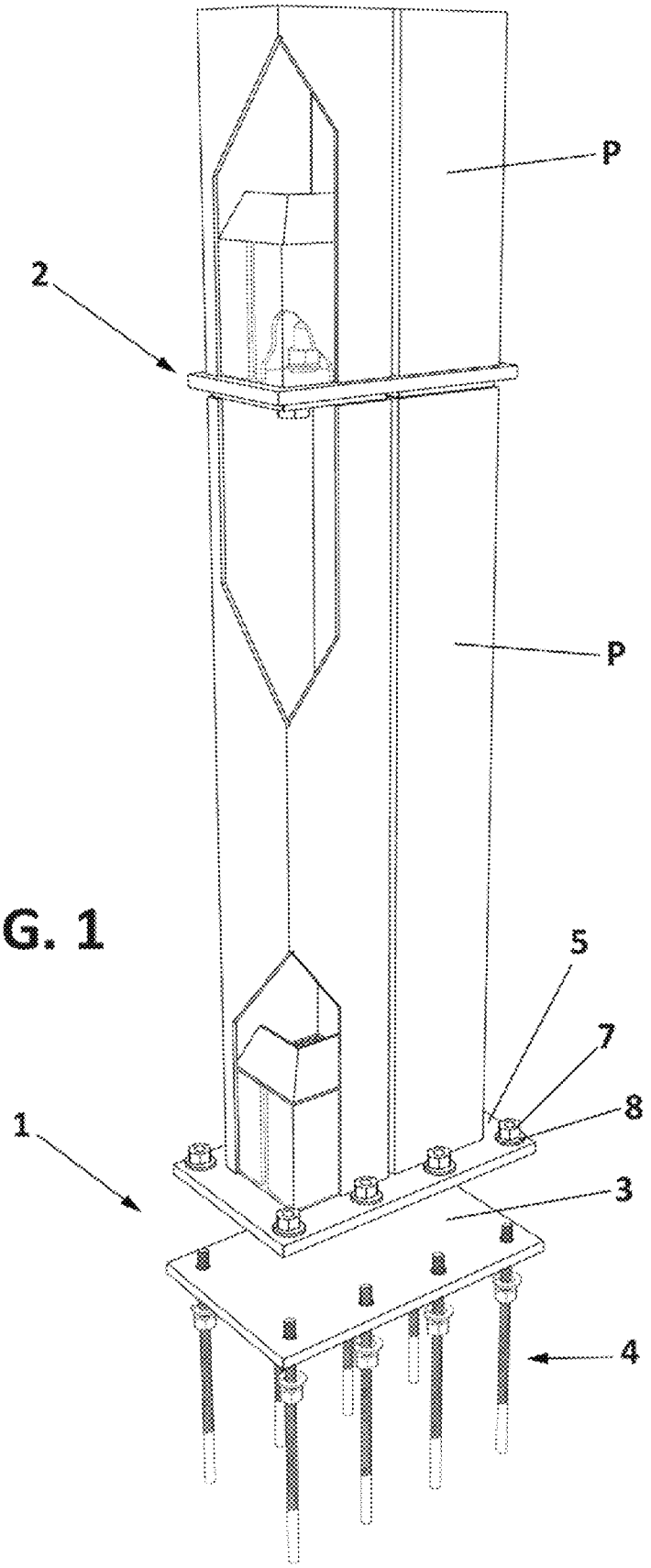
FIG. 1 shows a general perspective view of the anchoring device in use.

The anchoring device for industrialized modular constructions described comprises a first anchoring system (1) for connecting an industrialized unit to a building's foundation and a second anchoring system (2) for mutual connection of two industrialized units in a building. FIG. 1 shows a general perspective view of the anchoring device in use.

Figure 2:
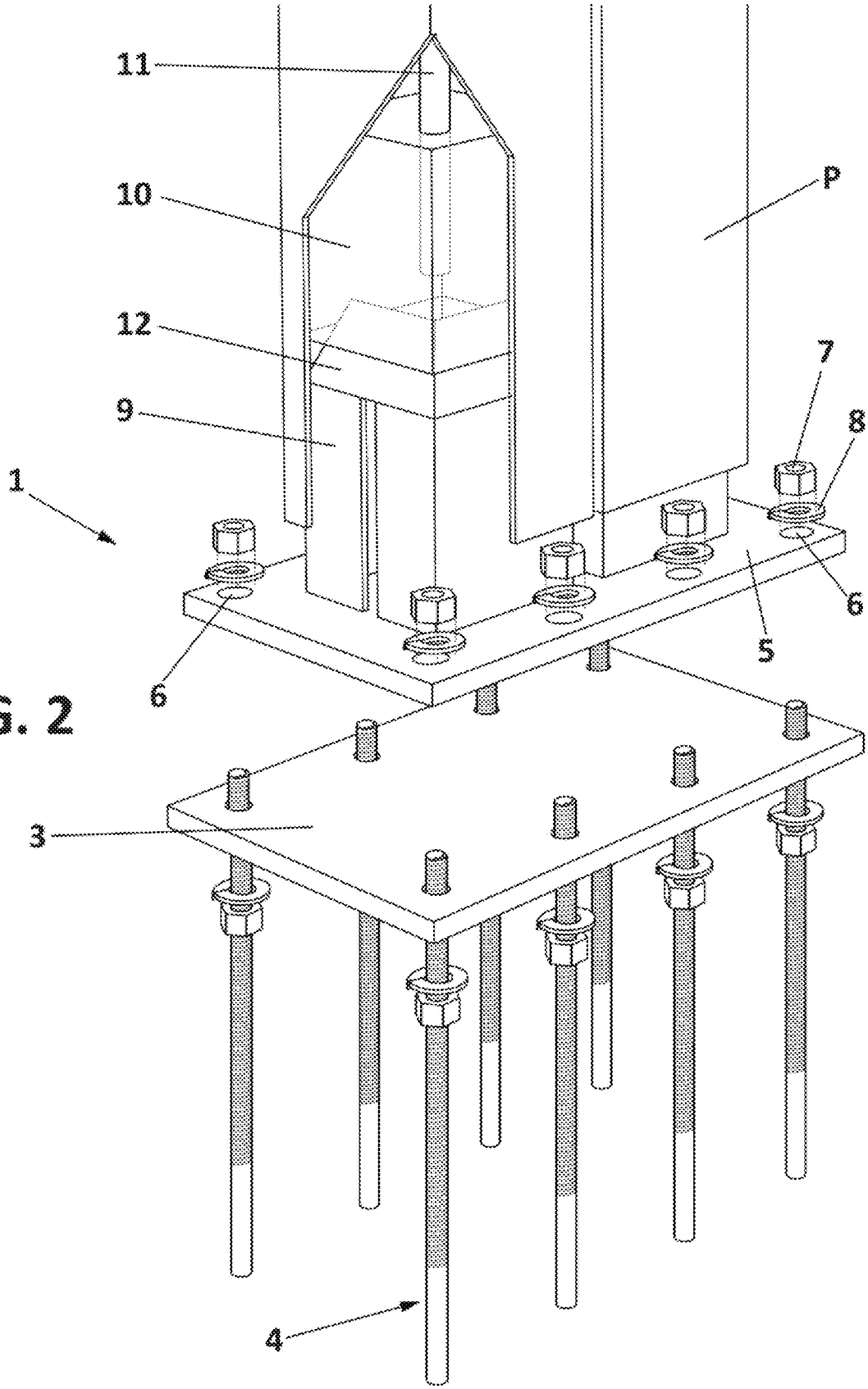
FIG. 2 shows a detail of the first anchor in use, from which a lateral section (as shown in FIG. 2A) with the anchor already assembled is extracted.
Figure 2A:
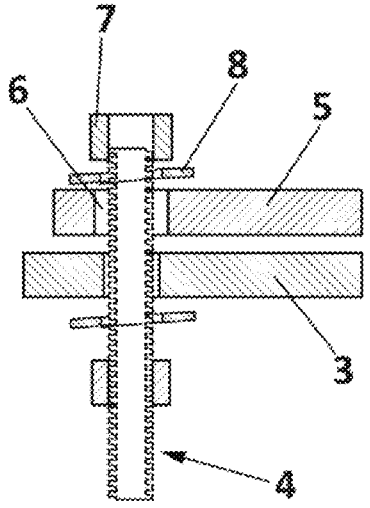

The first anchoring system (1), detailed in FIG. 2, consists of a first lower anchoring plate (3), adjustable in height relative to the building's foundation (not shown in the figure) using leveling means (4), in this preferred embodiment, composed of threaded rods, nuts, and oversized grower washers.

The first anchoring system (1) also includes a first upper anchoring plate (5), attached to the first lower anchoring plate (3) through the leveling means (4). Once the first upper (5) and lower (3) plates are correctly leveled in height, a fluid anchoring mortar is applied, solidifying the first lower plate (3) to the foundation and the first upper plate (5) to the first lower plate (3) using the leveling means (4).

In the detail of FIG. 2, the solid connection between the first lower plate (3) and the first upper plate (5) through the threaded rods of the leveling means (4) can be observed. Additionally, the system of nuts, washers, and threaded rods allowing the adjustment of the first lower plate (3) in terms of height is visible. The first upper plate (5) includes through-holes (6) with a diameter excess compared to corresponding holes in the first lower plate (3). This allows the plate-socket assembly to move to a position that enables the positioning of the plates (3, 5) to their theoretical position, absorbing any deviations that may have occurred during the work to embed the rods in the concrete slab. The first upper plate (5) is secured to the first lower plate (3) using a set of oversized nuts (7) and washers (8).

The first upper plate (5) also includes first joining sockets (9), as shown. There exists a peripheral gap of at least 5 mm between each of the first joining sockets (9) and an inner face of a pillar (P) of the industrialized unit, allowing for relative movement of the industrialized units to achieve facade alignment.

The fixation of the pillars (P) of the industrialized unit to the foundation is achieved by adding structural resin (10) from an upper face of the pillar (P) through a tube (11) inserted into the pillar (P) for this purpose.

Figure 4:
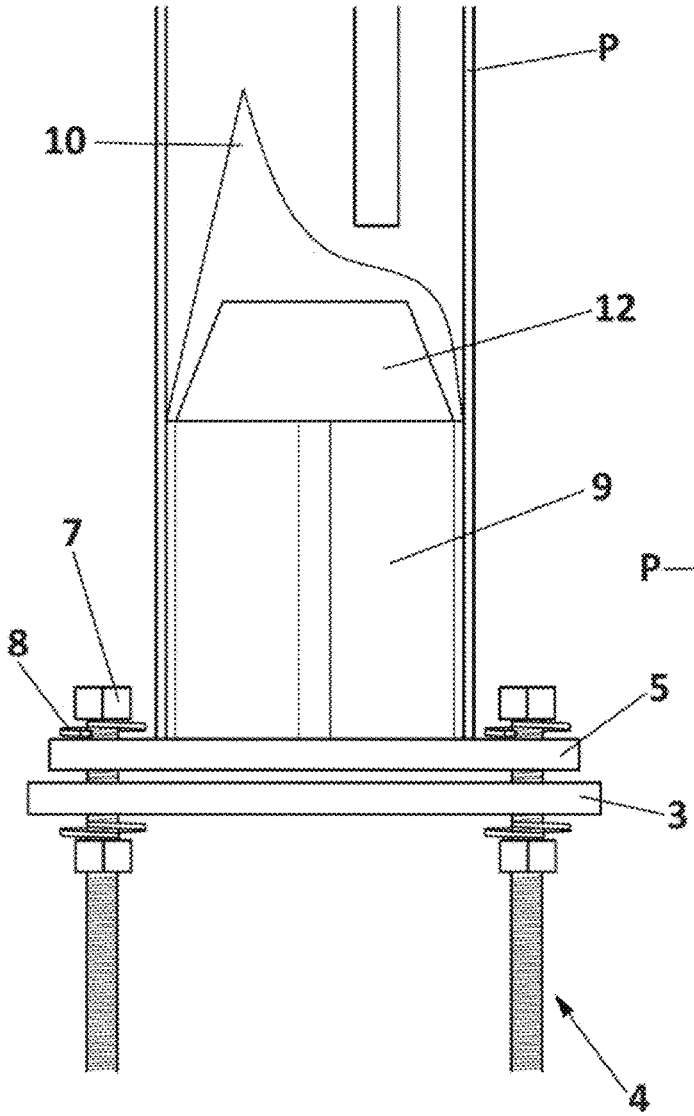
FIG. 4 shows a side view of a longitudinal section of the first anchor in use.
Figure 5:
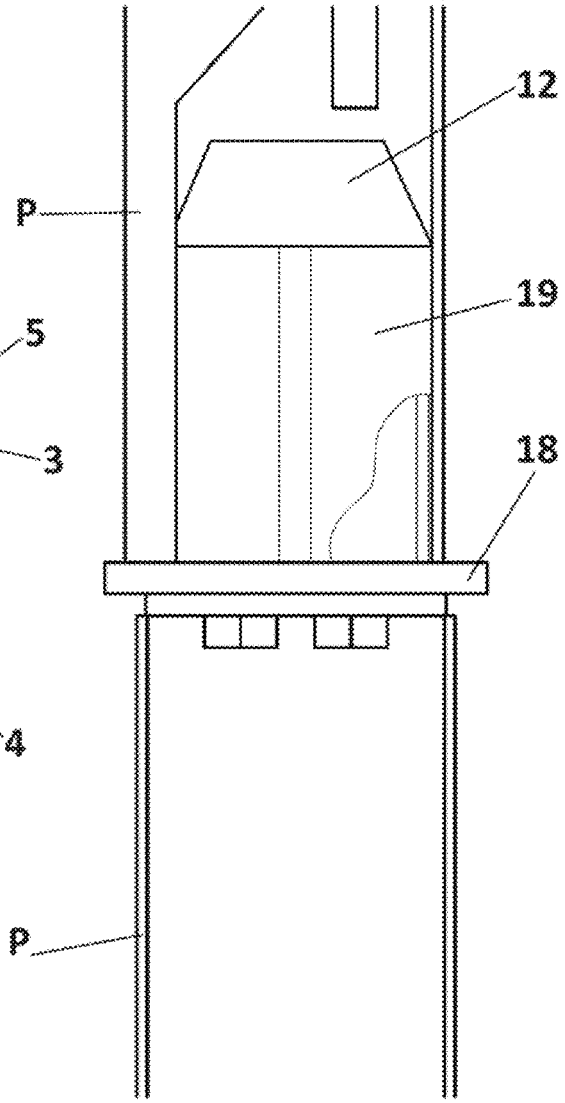
FIG. 5 shows a side view of a longitudinal section of the second anchor in use.

Each of the first joining sockets (9) includes a troncopiramidal tip (12) at its end for receiving the pillars (P) of the industrialized unit, as seen in FIG. 4. Thus, during the positioning of the industrialized units, the pillars (P) can be placed on the first joining sockets (9) for their definitive positioning without the need for auxiliary elements.

Advantageously, the fixation system using the addition of structural resin (10) allows for the completion of the enclosure and facade cladding in the factory, thus preventing rainwater from entering the dwelling during the assembly phase of the units on site. It also allows for the completion of interior work in the industrialized units, as there is no need to access the interior of these units for the adjustment and fixation operations between the pillars (P) and the first joining sockets (9).

Figure 3:
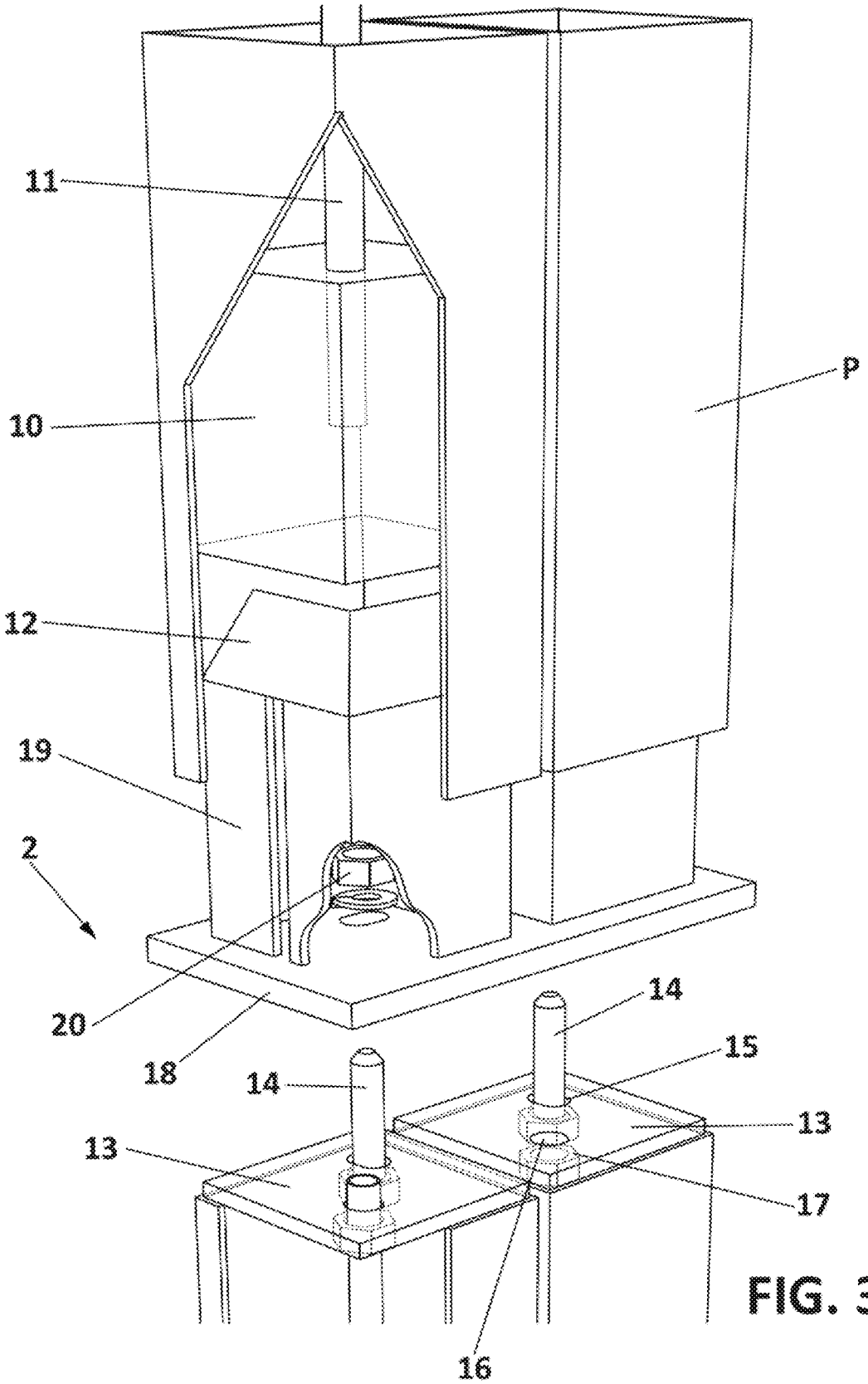
FIG. 3 shows a detail of the second anchor in use.

FIG. 3 shows the second anchoring system (2) between two industrialized units of a dwelling. It can be observed that a pair of second lower plates (13) include first screws (14), slotted holes (15), a through-hole (16), and a nut welded (17) to an underside of the second lower plates (13).

A joining plate (18) includes second sockets (19) welded, each of which includes at its tip the troncopiramidal tip (12).

The fixation of a joining plate (18) to the pillars (P) of the industrialized unit is achieved by screwing second nuts (20) onto the first screws (14). The adjustment of the position of the joining plate (18) and its second sockets (19) is done through the play provided by the slotted holes (15).

On the other hand, the connection between the pillars (P) and the joining plate (18) is achieved by bringing the troncopiramidal tips (12) closer together, so that, during the mutual positioning of the industrialized units, the pillars (P) can easily find the tips of the second sockets (19), without the need for auxiliary elements or risky operations for workers, etc.

There is a gap between the pillars (P) and the second sockets (19) allowing for adjustment of the upper industrialized units, aiming to achieve alignment of their facades. The fixation of these joints is achieved by adding structural resin (10) from the upper face of the pillar (P) through the tube (11) inserted into the pillar (P) for this purpose.

The invention claimed is:

1. An anchoring device for industrialized modular constructions, the anchoring device comprising:

a first anchoring system for joining a first industrialized unit to a foundation, the first anchoring system comprising:

a first lower anchoring plate, adjustable in height relative to the foundation using a leveling system, and a first upper anchoring plate comprising through-holes for passage of the leveling system, wherein the through-holes have a diametrical excess that allows displacement of the first upper anchoring plate relative to the first lower anchoring plate, wherein the first upper anchoring plate is fastened to the first lower anchoring plate by a set of nuts and washers, wherein the first upper anchoring plate comprises first welded joining sockets, and wherein each of the first welded joining sockets is fastened to a pillar of the first industrialized unit; and a second anchoring system for mutual joining of a second industrialized unit of a dwelling to the first industrialized unit, the second anchoring system comprising:

a pair of second lower plates, each of which comprises a first screw, a slotted hole, a through-hole, and a nut welded to an underside of the respective second lower plate; and a joining plate with second welded sockets, wherein the first welded joining sockets comprise, at a tip of the first welded joining sockets, a troncopiramidal tip for receiving the pillar of the first industrialized unit and the second welded sockets comprise, at a tip of the second welded sockets, a troncopiramidal tip for receiving a pillar of the second industrialized unit, and wherein fixation of joints is performed by structural resin added from a top face of one of the pillars through a tube inserted into the respective pillar.

2. The anchoring device according to claim 1, wherein the fixation of the joining plate is performed by screwing second nuts onto the first screws of the pair of second lower plates.

* * * * *